US007676957B2

(12) United States Patent
Johnson

(10) Patent No.: US 7,676,957 B2
(45) **Date of Patent: *Mar. 16, 2010**

(54) AUTOMATED TIGHTENING SHOE

(76) Inventor: Gregory G. Johnson, 7310 132nd St. North, Hugo, MN (US) 55036

( * ) Notice: Subject to any disclaimer, the term of this patent is extended or adjusted under 35 U.S.C. 154(b) by 156 days.

This patent is subject to a terminal disclaimer.

(21) Appl. No.: 12/004,895

(22) Filed: Dec. 21, 2007

(65) Prior Publication Data

US 2008/0307673 A1 Dec. 18, 2008

Related U.S. Application Data

(63) Continuation-in-part of application No. 11/818,370, filed on Jun. 14, 2007.

(51) Int. Cl.
*A43C 11/00* (2006.01)

(52) U.S. Cl. ..... 36/50.1

(58) Field of Classification Search ..... 36/50.1, 36/50.5, 138, 58.6, 58.5
See application file for complete search history.

(56) References Cited

U.S. PATENT DOCUMENTS 4,654,985 A * 4/1987 Chalmers ..... 36/118.2
4,811,503 A * 3/1989 Iwama ..... 36/118.1
5,157,813 A 10/1992 Carroll
5,158,559 A 10/1992 Pozzobon et al.
5,791,068 A * 8/1998 Bernier et al. ..... 36/50.1
6,032,387 A 3/2000 Johnson
6,378,230 B1 4/2002 Rotem et al.
6,467,194 B1 * 10/2002 Johnson ..... 36/50.1
6,896,128 B1 * 5/2005 Johnson ..... 36/50.1
7,096,559 B2 * 8/2006 Johnson ..... 29/433
7,103,994 B2 * 9/2006 Johnson ..... 36/50.1
7,331,126 B2 * 2/2008 Johnson ..... 36/50.1
2002/0095750 A1 * 7/2002 Hammerslag ..... 24/68 SK
2005/0039348 A1 * 2/2005 Raluy et al. ..... 36/50.1
2005/0198866 A1 * 9/2005 Wiper et al. ..... 36/50.1

FOREIGN PATENT DOCUMENTS

FR 2399811 3/1979
WO WO 2004/034831 4/2004

* cited by examiner

*Primary Examiner*—Ted Kavanaugh
(74) *Attorney, Agent, or Firm*—Moss & Barnett

(57) ABSTRACT

An automated tightening shoe with crisscrossed laces or closure panel and a tightening mechanism which operates in one direction to cause automatic tightening of the crisscrossed laces or closure panel to tighten the shoe about a wearer's foot, and which can be released easily so that the shoe can be removed from the wearer's foot. An actuating wheel partially projecting from the rear sole of the shoe provides a convenient and reliable actuating means for movement of the automated tightening mechanism in the tightening direction.

20 Claims, 8 Drawing Sheets

AUTOMATED TIGHTENING SHOE

CROSS-REFERENCE TO RELATED APPLICATION

This application is a continuation-in-part of U.S. Ser. No. 11/818,370 filed on Jun. 14, 2007, which is hereby incorporated by reference in its entirety.

FIELD OF THE INVENTION

The present invention pertains to a shoe and, more particularly, to an automated tightening shoe. The shoe is provided with an automated tightening system, including a tightening mechanism which operates in one direction to cause automatic tightening of the shoe about a wearer's foot, and which can be released easily so that the shoe can be readily removed from the wearer's foot. The invention is chiefly concerned with an automated tightening shoe of the sport or athletic shoe variety, but the principles of the invention are applicable to shoes of many other types and styles.

BACKGROUND OF THE INVENTION

Footwear, including shoes and boots, are an important article of apparel. They protect the foot and provide necessary support, while the wearer stands, walks, or runs. They also can provide an aesthetic component to the wearer's personality.

A shoe comprises a sole constituting an outsole and heel, which contact the ground. Attached to a shoe that does not constitute a sandal or flip flop is an upper that acts to surround the foot, often in conjunction with a tongue. Finally, a closure mechanism draws the medial and lateral portions of the upper snugly around the tongue and wearer's foot to secure the shoe to the foot.

The most common form of a closure mechanism is a lace criss-crossing between the medial and lateral portions of the shoe upper that is pulled tight around the instep of the foot, and tied in a knot by the wearer. While simple and practical in functionality, such shoe laces need to be tied and retied throughout the day as the knot naturally loosens around the wearer's foot. This can be a hassle for the ordinary wearer. Moreover, young children may not know how to tie a knot in the shoe lace, thereby requiring assistance from an attentive parent or caregiver. Furthermore, elderly people suffering from arthritis may find it painful or unduly challenging to pull shoe laces tight and tie knots in order to secure shoes to their feet.

The shoe industry over the years has adopted additional features for securing a tied shoe lace, or alternative means for securing a shoe about the wearer's foot. Thus, U.S. Pat. No. 737,769 issued Preston in 1903 added a closure flap across the shoe instep secured to the upper by an eyelet and stud combination. U.S. Pat. No. 5,230,171 issued to Cardaropoli employed a hook and eye combination to secure the closure flap to the shoe upper. A military hunting boot covered by U.S. Pat. No. 2,124,310 issued to Murr, Jr. used a lace zigzagging around a plurality of hooks on the medial and lateral uppers and finally secured by means of a pinch fastener, thereby dispensing with the need for a tied knot. See also U.S. Pat. Nos. 6,324,774 issued to Zebe, Jr.; and 5,291,671 issued to Caberlotto et al.; and U.S. Application 2006/0191164 published by Dinndorf et al. Other shoe manufactures have resorted to small clamp or pinch lock mechanisms that secure the lace in place on the shoe to retard the pressure applied throughout the day by the foot within the shoe that pulls a shoe lace knot apart. See, e.g., U.S. Pat. Nos. 5,335,401 issued to Hanson; 6,560,898 issued to Borsoi et al.; and 6,671,980 issued to Liu.

Other manufactures have dispensed entirely with the shoe lace. For example, ski boots frequently use buckles to secure the boot uppers around the foot and leg. See, e.g., U.S. Pat. Nos. 3,793,749 issued to Gertsch et al., and 6,883,255 issued to Morrow et al. Meanwhile, U.S. Pat. No. 5,175,949 issued to Seidel discloses a ski boot having a yoke extending from one part of the upper that snap locks over an upwardly protruding "nose" located on another portion of the upper with a spindle drive for adjusting the tension of the resulting lock mechanism. Because of the need to avoid frozen or ice-bound shoe laces, it is logical to eliminate external shoe laces from ski boots, and substitute an external locking mechanism that engages the rigid ski boot uppers.

A different approach employed for ski boots has been the use of internally routed cable systems tightened by a rotary ratchet and pawl mechanism that tightens the cable, and therefore the ski boot, around the wearer's foot. See, e.g., U.S. Pat. Nos. 4,660,300 and 4,653,204 issued to Morell et al.; 4,748,726 issued to Schoch; 4,937,953 issued to Walkhoff; and 4,426,796 issued to Spademan. U.S. Pat. No. 6,289,558 issued to Hammerslang extended such a rotary ratchet-and-pawl tightening mechanism to an instep strap of an ice skate. Such a rotary ratchet-and-pawl tightening mechanism and internal cable combination have also been applied to athletic and leisure shoes. See, e.g., U.S. Pat. Nos. 5,157,813 issued to Carroll; 5,327,662 and 5,341,583 issued to Hallenbeck; and 5,325,613 issued to Sussmann.

U.S. Pat. Nos. 4,787,124 issued to Pozzobon et al.; 5,152,038 issued to Schoch; 5,606,778 issued to Jungkind; and 7,076,843 issued to Sakabayashi disclose other embodiments of rotary tightening mechanisms based upon ratchet-and-pawl or drive gear combinations operated by hand or a pull string. These mechanisms are complicated in their number of parts needed to operate in unison.

Still other mechanisms are available on shoes or ski boots for tightening an internally or externally routed cable. A pivotable lever located along the rear upper operated by hand is taught by U.S. Pat. Nos. 4,937,952 issued to Olivieri; 5,167,083 issued to Walkhoff; 5,379,532 issued to Seidel; and 7,065,906 issued to Jones et al. A slide mechanism operated by hand positioned along the rear shoe upper is disclosed by U.S. Application 2003/0177661 filed by Tsai for applying tension to externally routed shoelaces. See also U.S. Pat. Nos. 4,408,403 issued to Martin, and 5,381,609 issued to Hieblinger.

Other shoe manufacturers have designed shoes containing a tightening mechanism that can be activated by the wearer's foot instead of his hand. For example, U.S. Pat. No. 6,643,954 issued to Voswinkel discloses a tension lever located inside the shoe that is pressed down by the foot to tighten a strap across the shoe upper. Internally routed shoe lace cables are actuated by a similar mechanism in U.S. Pat. Nos. 5,983,530 and 6,427,361 issued to Chou; and 6,378,230 issued to Rotem et al. However, such tension lever or push plate may not have constant pressure applied to it by the foot, which will result in loosening of the tightening cable or strap. Moreover, the wearer may find it uncomfortable to step on the tension lever or push plate throughout the day. U.S. Pat. No. 5,839,210 issued to Bernier et al. takes a different approach by using a battery-charged retractor mechanism with an associated electrical motor positioned on the exterior of the shoe for pulling several straps across the shoe instep. But, such a battery-operated device can suffer from short circuits, or subject the wearer to a shock in a wet environment.

The shoe industry has also produced shoes for children and adults containing Velcro® straps in lieu of shoelaces. Such straps extending from the medial upper are readily fastened to a complementary Velcro patch secured to the lateral upper. But, such Velcro closures can frequently become disconnected when too much stress is applied by the foot. This particularly occurs for athletic shoes and hiking boots. Moreover, Velcro closures can become worn relatively quickly, losing their capacity to close securely. Furthermore, many wearers find Velcro straps to be aesthetically ugly on footwear.

Gregory G. Johnson, the present applicant, has developed a number of shoe products containing automated tightening mechanisms located within a compartment in the sole or along the exterior of the shoe for tightening interior or exterior cables positioned inside or outside the shoe uppers, while preventing unwanted loosening of the cables. Such tightening mechanism can entail a pair of gripping cams that engage the tightened cable, a track-and-slide mechanism that operates like a ratchet and pawl to allow movement in the tightening direction, while preventing slippage in the loosening direction, or an axle assembly for winding the shoe lace cable that also bears a ratchet wheel engaged by a pawl on a release lever for preventing counter-rotation. Johnson's automated tightening mechanisms can be operated by a hand pull string or track-and-slide mechanism, or an actuating lever or push plate extending from the rear of the shoe sole that is pressed against the ground or floor by the wearer to tighten the shoe lace cable. An associated release lever may be pressed by the wearer's hand or foot to disengage the automated tightening mechanism from its fixed position to allow loosening of the shoe lace or cables for taking off the shoe. See U.S. Pat. Nos. 6,032,387; 6,467,194; 6,896,128; 7,096,559; and 7,103,994 issued to Johnson.

However, none of the automated tightening systems heretofore devised has been entirely successful or satisfactory. Major shortcomings of the automated tightening systems of the prior art are that they fail to tighten the shoe from both sides so that it conforms snugly to the wearer's foot, and that they lack any provision for quickly loosening the shoe when it is desired to remove the shoe from the wearer's foot. Moreover, they frequently suffer from: (1) complexity, in that they involve numerous parts; (2) the inclusion of expensive parts, such as small electric motors; (3) the use of parts needing periodic replacement, e.g. a battery; or (4) the presence of parts requiring frequent maintenance. These aspects, as well as others not specifically mentioned, indicate that considerable improvement is needed in order to attain an automated tightening shoe that is completely successful and satisfactory.

Therefore, it would be advantageous to provide a shoe or other footwear product containing an automated tightening mechanism that is simple in design with few operating parts that can be operated by the foot without use of the wearer's hands, such as by a roller wheel extending from the heel of the shoe sole. Shoes that can be converted into a roller skate via a roller wheel that pivots out of a storage compartment in the sole are known. See, e.g., U.S. Pat. Nos. 6,926,289 issued to Wang, and 7,195,251 issued to Walker. Such a popular shoe is sold under the brand Wheelies®. However, this type of convertible roller skating shoe does not contain an automated tightening mechanism, let alone use the roller wheel to actuate such a mechanism. The roller is used instead solely for recreational purposes.

SUMMARY OF THE INVENTION

An automated tightening shoe that tightens snugly around the wearer's foot without use of the wearer's hands, and that can be loosened easily upon demand is provided by this invention. The automated tightening shoe contains a sole and an integral body member or shoe upper constructed of any suitable material. The shoe upper includes a toe, a heel, a tongue, and medial and lateral sidewall portions. A lace or pair of laces is provided for engaging a series of eyelets in a reinforced lacing along the periphery of the medial and lateral uppers. This lace or laces are pulled by the automated tightening mechanism in a crisscrossed fashion across the tongue to draw the medial and lateral shoe uppers around the wearer's foot and snugly against the tongue on top of the wearer's instep. Alternatively, a closure panel secured to the medial shoe upper and extending across the tongue to be pulled to the lateral shoe upper by the automated tightening mechanism, or pulled from both sides by the automated tightening mechanism, may be substituted for the shoe laces.

This automated tightening mechanism assembly is preferably located within a chamber contained within the shoe sole, and comprises a rotatable axle for winding an engagement cable attached to the shoe laces or closure panel. A roller wheel is attached to the axle that extends partially from the rear sole of the shoe, so that the wearer can rotate the roller wheel on the ground or floor to bias the axle of the automated tightening mechanism in the tightening direction. A ratchet wheel having ratchet teeth also secured to the axle is successively engaged by a pawl at the distal end of a release lever to prevent the axle from counter-rotating. When the wearer engages the release lever preferably extending from the heel of the shoe, however, the pawl is pivoted out of engagement with the teeth of the ratchet wheel, so that the axle of the automated tightening mechanism can freely counter-rotate to release the tightening cable to its standby position, and allow the shoe laces or closure panel to be loosened.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

An automated tightening shoe containing a wheel-actuated tightening mechanism for tightening criss-crossed shoe laces or a closure panel for drawing the shoe upper around the wearer's foot is provided by the invention. Such automated tightening mechanism assembly preferably comprises an axle for winding an engagement cable connected to the shoe laces or closure panel in a tightening direction, a fixed roller wheel partially projecting preferably from the rear sole of the shoe for rotating the axle in the tightening direction, and a fixed ratchet wheel with ratchet teeth for successively engaging a pawl on the end of a release lever to prevent the axle from counter-rotating. When the release lever is biased to disengage the pawl from the ratchet wheel teeth, the axle can freely counter-rotate to release the engagement cable to allow the shoe lace or closure panel to loosen. This invention provides an automated tightening mechanism that has few parts, and is reliable in its operation.

For purposes of the present invention, "shoe" means any closed footwear product having an upper part that helps to hold the shoe onto the foot, including but not limited to boots; work shoes; snow shoes; ski and snowboard boots; sport or athletic shoes like sneakers, tennis shoes, running shoes, golf shoes, cleats, and basketball shoes; ice skates, roller skates; in-line skates; skateboarding shoes; bowling shoes; hiking shoes or boots; dress shoes; casual shoes; walking shoes; dance shoes; and orthopedic shoes.

Although the present invention may be used in a variety of shoes, for illustrative purposes only, the invention is described herein with respect to athletic shoes. This is not meant to limit in any way the application of the automated tightening mechanism of this invention to other appropriate or desirable types of shoes.

Figure 1:
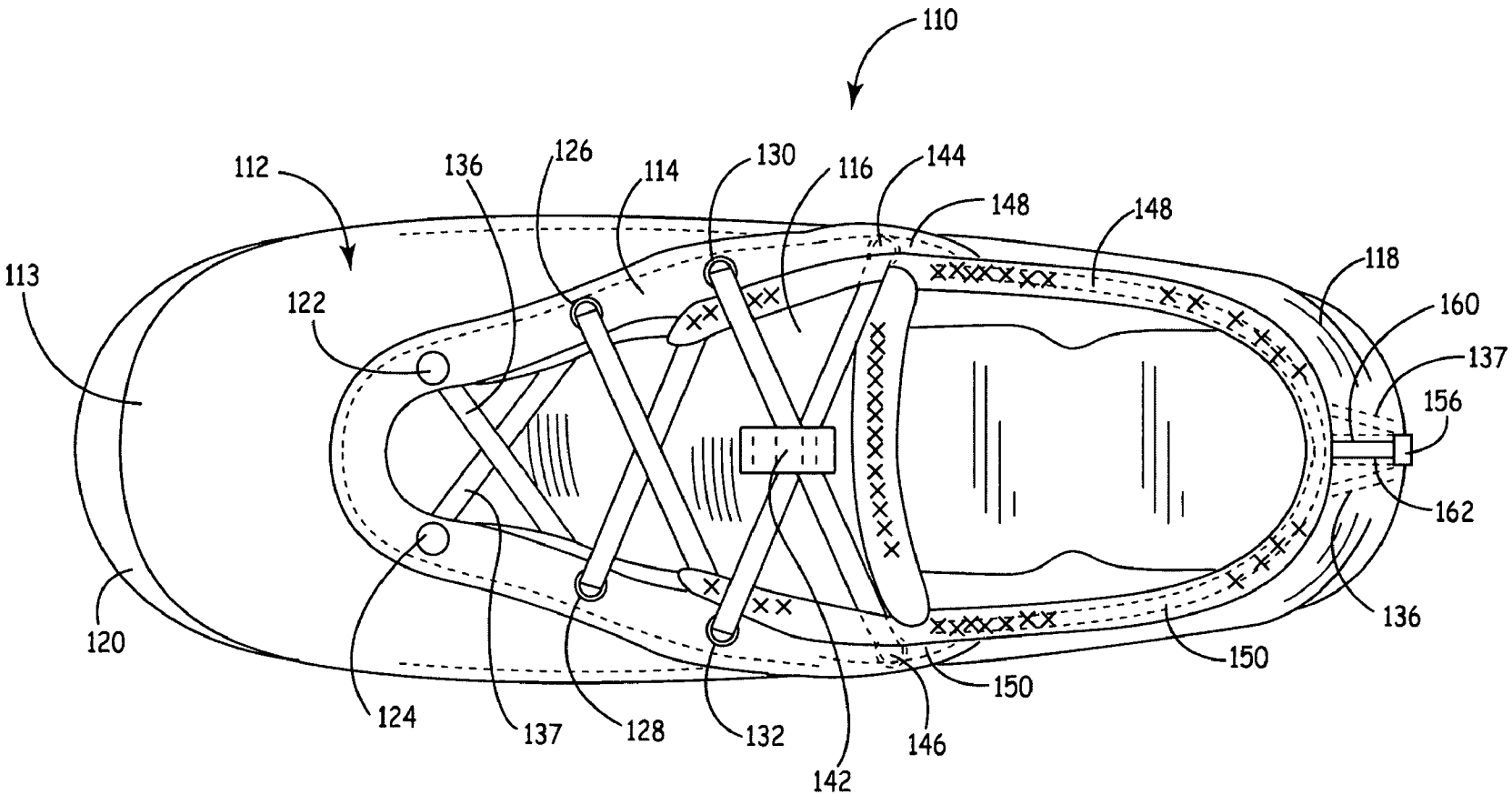
FIG. 1 illustrates a top view of an automated tightening shoe of the present invention having crisscrossed laces in the loosened condition.
Figure 2:
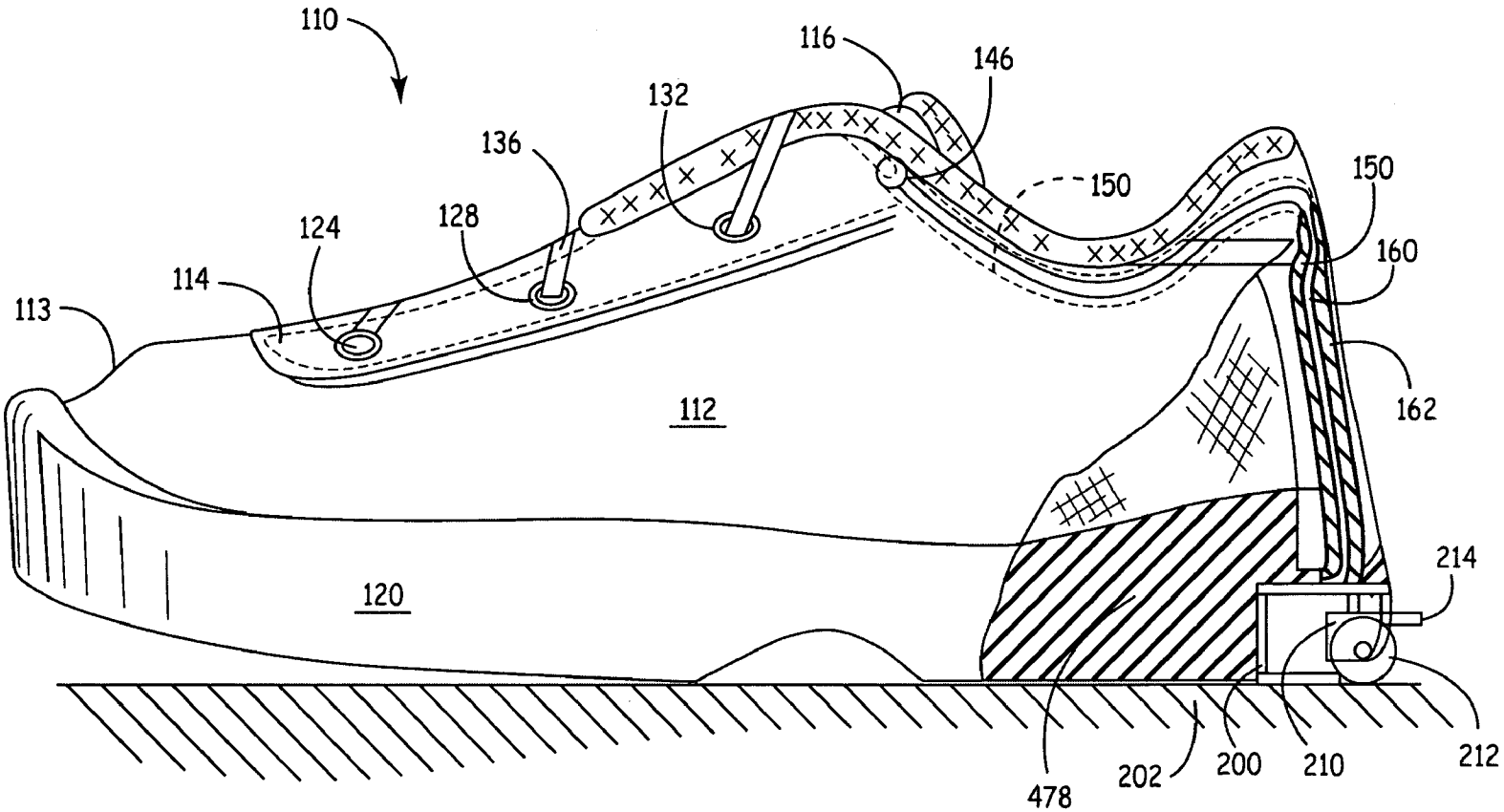
FIG. 2 illustrates a side view, in partial cutaway, of the automated tightening shoe embodiment of FIG. 2.

FIG. 1 illustrates a top view of an automated tightening shoe 110 of the present invention in the open condition, and FIG. 2 illustrates a side view, in partial cutaway, of the automated tightening shoe 110 showing the tightening mechanism.

The automated tightening shoe 110 has a sole 120, an integral body member or shoe upper 112 including a tongue 116, a toe 113, a heel 118, and a reinforced lacing pad 114, all constructed of any appropriate material for the end use application of the shoe.

At the toe 113 end of tongue 116, there are provided two anchor buttons 122 and 124 which are secured to shoe laces 136 and 137, respectively, at one end. The shoe laces 136 and 137 then crisscross over tongue 116 and pass through lace eyelets 126, 128, 130, and 132, as illustrated, before passing through lace containment loop 142. After passing through lace containment loop 142, lace 136 passes through a hole 146 in the reinforced lacing pad 114 and travels rearwardly through a section of tubing 150 which passes in-between the outer and inner materials of the shoe upper 112 and down the heel of the shoe. Lace 137 passes through a hole 144 in the reinforced lacing pad 114 and travels rearwardly through a section of tubing 148 which also passes in-between the outer and inner materials of the shoe upper 112 and down the heel of the shoe, as illustrated. The laces 136 and 137 may alternatively join engagement cable 160 that passes through a section of tubing 162 which passes down the heel of the shoe upper 112 in between the outer and inner materials of the shoe upper.

For purposes of this invention, a single lace can be used, joined at its middle region to anchor buttons 122 and 124 with the ends criss-crossed through the eyelets, as shown in FIG. 1. Alternatively, a zig-zag lacing pattern may be used instead of the criss-crossed pattern. In this zig-zag configuration, the lace fastened, e.g., to anchor button 124 passes sequentially through eyelets 126, 132, and hole 144 to then travel through tube 148 to be secured at its other end to the automated tightening mechanism.

Figure 3:
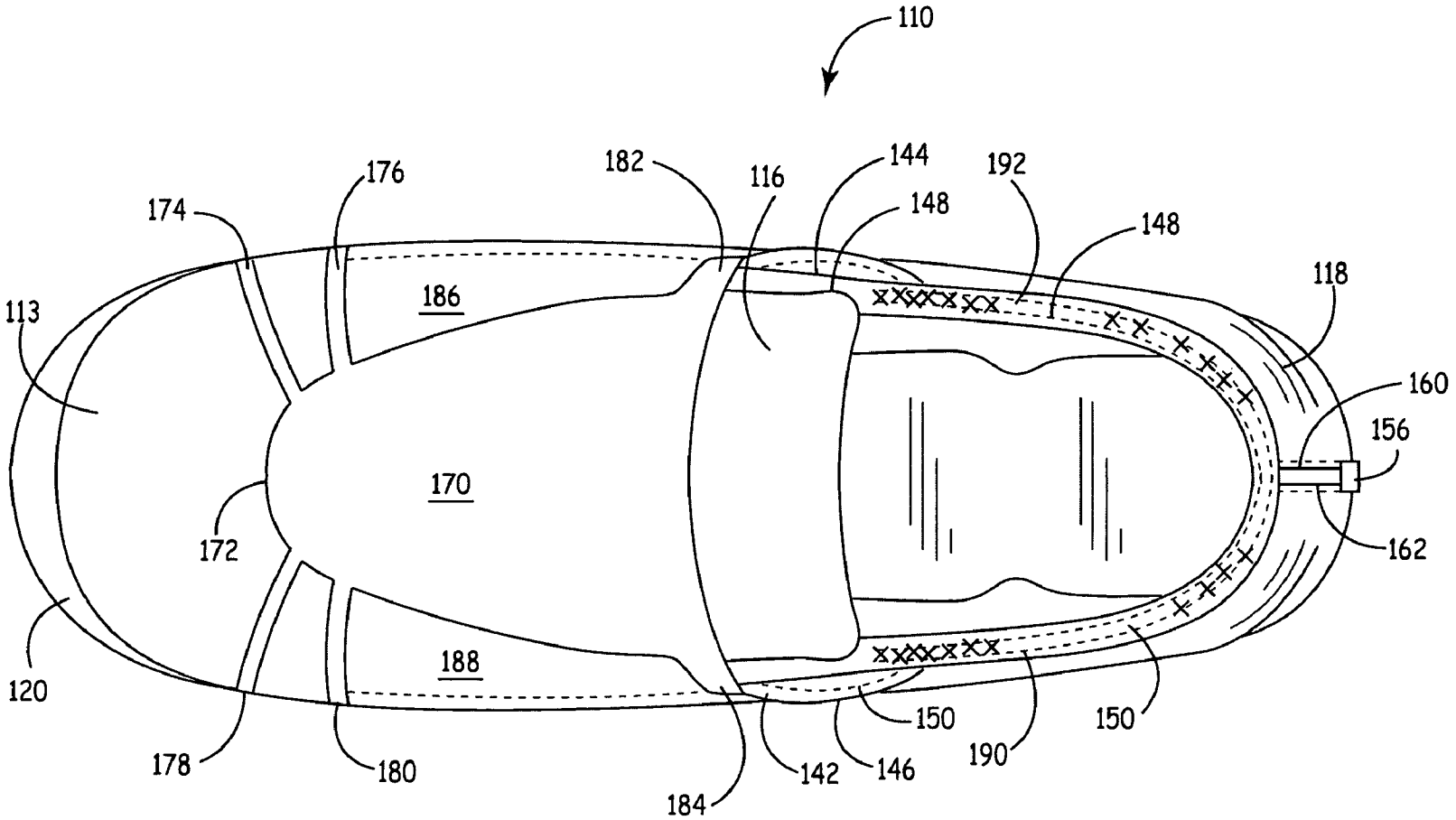
FIG. 3 illustrates a top view of an automated tightening shoe of the present invention having a closure panel.

Automated tightening shoe 110 may alternatively employ closure panel 170 instead of crisscrossed shoe laces 136, 137 or zig-zag lace, as shown in FIG. 3. Closure panel 170 is secured at its forward end 172 to shoe sole 120 by means of lower tabs 174 and 176 along the medial support side, and tabs 178 and 180 along the lateral support side. Closure panel 170 covers tongue 116. Meanwhile, upper tabs 182 and 184, respectively, are secured to engagement cables 190 and 192 which tighten closure panel 170 by means of the automated tightening mechanism described below. Alternatively, closure panel 170 could be fastened along its one side to medial upper 186, and then pulled against lateral upper 188 by means of engagement cable 146.

The lower end of tubing 148, 150, 162 enters chamber 200 located in the sole 120 of the automated tightening shoe 110. It should be noted that the engagement cable 160 or laces 136, 137 may alternatively be routed along the exterior of the shoe upper for purposes of this invention in order to dispense with the need for the tubing.

Automated tightening mechanism 210 is located in housing 200 secured to housing base plate 202, as shown more fully in FIG. 2. Secured to automated tightening mechanism 210 and projecting partially beyond the rear sole portion of shoe 110 is actuating wheel 212. By rolling actuating wheel 212 on the floor or ground, automated tightening mechanism 210 is rotated to a tightened position. Engagement cable 190, 192, 160 extend downwardly into chamber 200 and are secured at their end to tightening mechanism 210 to tighten the shoe laces 136 and 137, or closure panel 170. Release lever 214 extends preferably from the rear upper of the shoe 110 to provide a convenient means for loosening the automated tightening mechanism, as described more fully herein.

Figure 4:
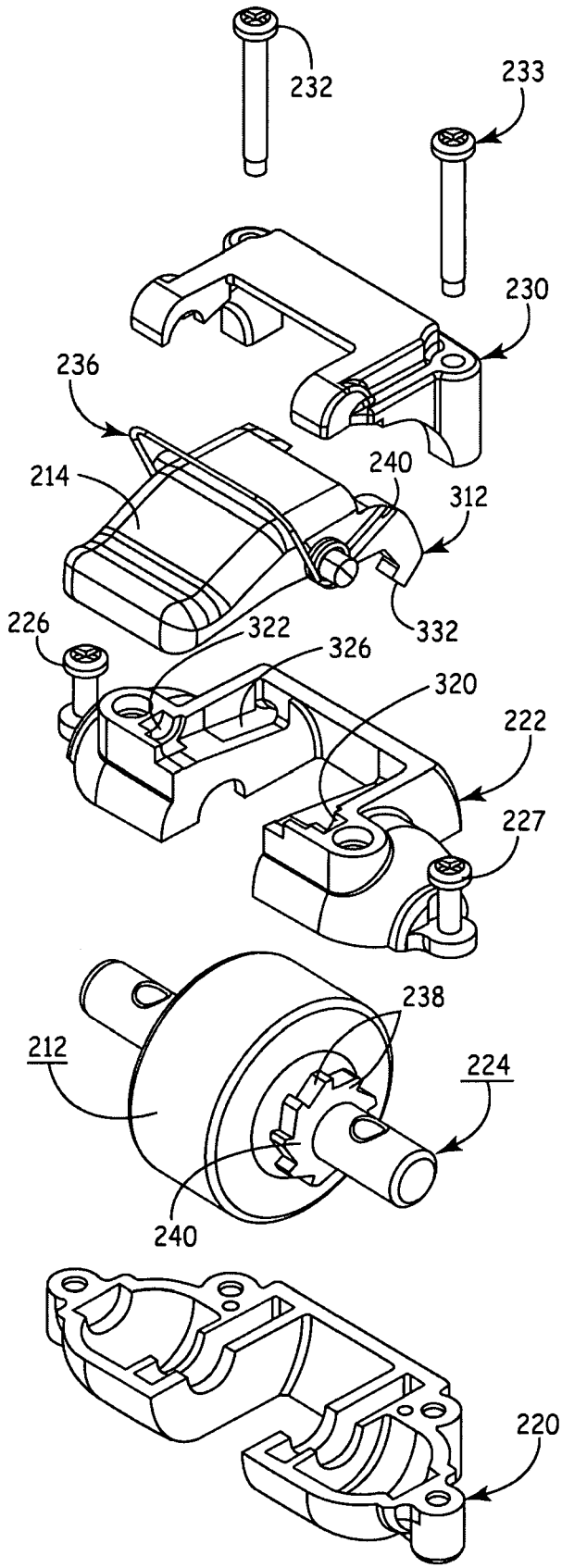
FIG. 4 illustrates an exploded perspective view of the parts of the automated tightening mechanism of the present invention.

The automated tightening mechanism 210 is shown in greater detail in FIG. 4. It comprises a case bottom 220 and a case top 222, between which main shaft assembly 224 is secured. Screws 226 and 227 fasten case cap 222 to case bottom 220. Release lever 214 is secured to case top 222 by means of case cap 230 and screws 232 and 233. Torsion spring 236 secured to release lever 214 interacts with the interior surface of case cap 230 to bias release lever 214 into an engaged position with the teeth 238 of ratchet wheel 240 on main shaft assembly 224.

Figure 5:
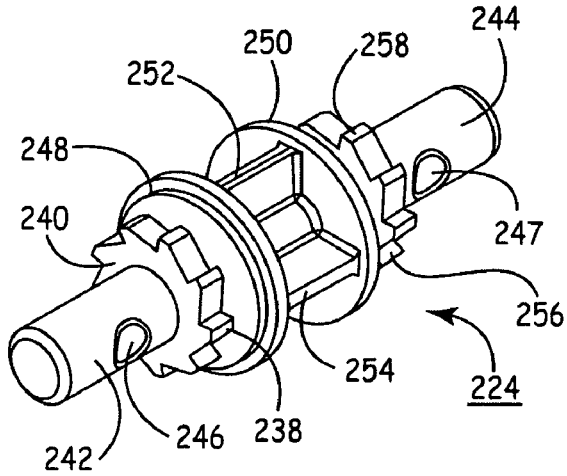
FIG. 5 illustrates a perspective view of the shaft assembly of the automated tightening mechanism without the actuating wheel.

The main shaft 224 is shown more fully in FIG. 5. It comprises preferably an integral unit molded from RTP 301 polycarbonate glass fiber 10% or functionally equivalent material having a first axle portion 242 and a second axle portion 244. Through holes 246 and 247 are used to secure the ends of engagement cables 190 and 192 to axles 242 and 244. First collar 248 and second collar 250 cooperate with fins 252, 254, etc. to secure actuator wheel 212 to the main shaft 224. Also integrally molded around axles 242 and 244 are ratchet wheels 240 and 256. The ratchet wheels have a plurality of teeth 248 and 258 extending from their perimeter.

The actuator wheel and ratchet wheels may alternatively be screwed, rivoted, or otherwise fastened to a separator axle. While the invention is shown with two ratchet wheels, a single ratchet wheel or three or more ratchet wheels may also suffice.

Figure 6:
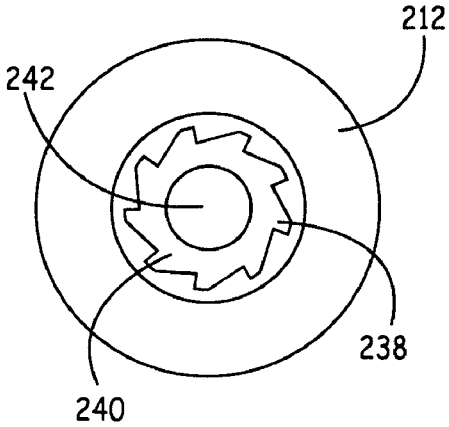
FIG. 6 illustrates a side view of the shaft assembly with the actuating wheel.

FIG. 6 shows actuator wheel 212 secured to wheel shaft 242 with ratchet wheel 240 extending from axle 242 in an integrally fixed relationship. Rolling actuator wheel 212 partially extending from the heel of shoe 110 will rotate axle 242 and ratchet wheel 240 in a co-directional fashion. Actuator wheel 212 should be manufactured from shore 70A urethane or functionally equivalent material. The wheel should preferably be one inch in diameter and have a 0.311 $in^3$ volume. Such a wheel size will be large enough to extend from the shoe heel, while fitting within housing 200 in the sole of shoe 110. Depending upon the size of the shoe and its end-use application, actuator wheel 212 could have a diameter range of ¼-1½ inches.

Figure 7:
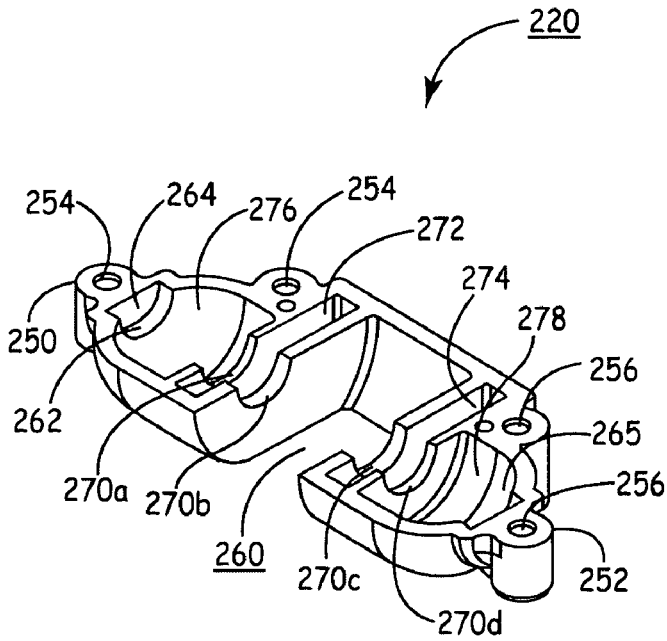
FIG. 7 illustrates a perspective view of the case bottom of the automated tightening mechanism.

Case bottom 220 as shown in FIG. 7 is preferably molded from RTP 301 polycarbonate glass fiber 10% or functionally equivalent material. Extending from its ends are ears 250 and 252 having threaded screw holes 254 and 256. Case bottom 220 features cut-away portion 260 for accommodating actuator wheel 212. Actuator wheel 212 must be cable of rotating freely without rubbing against case bottom 220. Shoulder surfaces 262 and 263 defined by indents 264 and 265 provide a bearing surface for the ends of axles 242 and 244 and cooperate with case top 222 to secure shaft 224 within the housing provided by case bottom 220 and case top 222. Shoulders 270*a*, 270*b*, 270*c*, and 270*d* provide additional means of support for the axles 242 and 244. Wells 272 and 274 in case bottom 220 accommodate ratchet wheels 240 and 256 of shaft assembly 240. Finally wells 276 and 278 accommodate engagement cables 190 and 192 as they are wound around axles 242 and 244.

Figure 8:
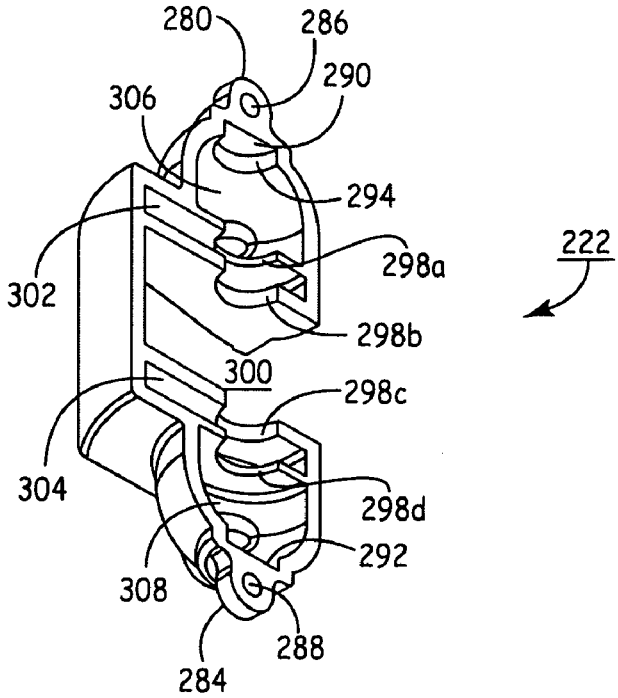
FIG. 8 illustrates a perspective, upside-down view of the case top of the automated tightening mechanism.

The underneath side of case top 222 is shown in FIG. 8. Ears 280 and 282 contain through holes 254 and 286 for screws 226 and 227 used to secure case top 222 to case bottom 220. Indents 290 and 292 secure the ends of axles 242 and 244. The axles are supported by shoulders 294 and 296 and 298*a*, 298*b*, 298*c*, and 298*d*. Cut-away region 300 accommodates actuator wheel 212. Wells 302 and 304 accommodate ratchet wheels 240 and 256. Wells 306 and 308 accommodate engagement cables 150 and 145 as they are wound around axles 242 and 244 of shaft assembly 240.

Figure 9:
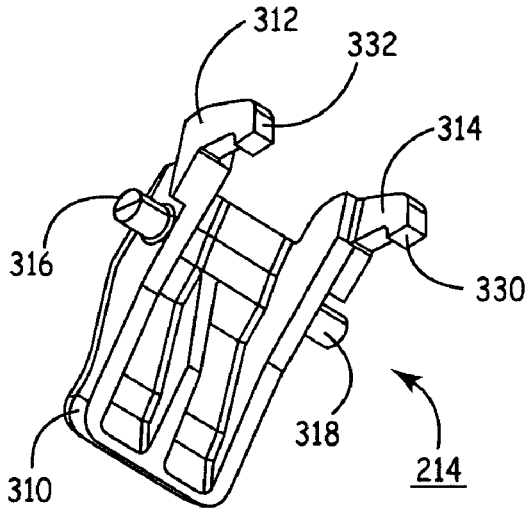
FIG. 9 illustrates an upside-down, perspective view of the release lever of the automated tightening mechanism.
Figure 10:
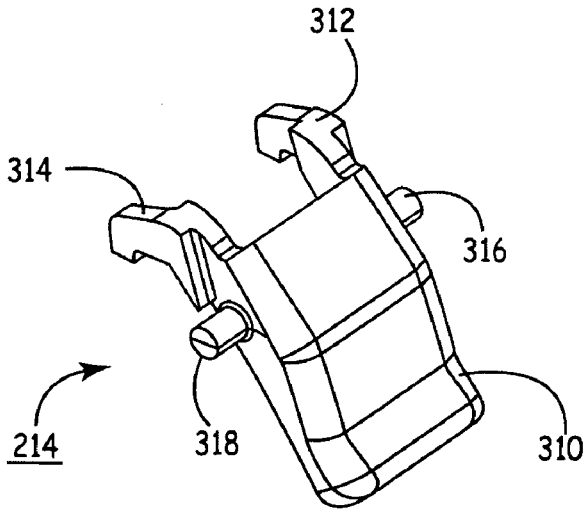
FIG. 10 illustrates a perspective view of the release lever.

Release lever 214 is shown in greater detail in FIGS. 9-10. It is preferably molded from RTP 301 polycarbonate glass fiber 10% or functionally equivalent material. It comprises a lever 310 at one end and two arms 312 and 314 at the other end. Extending from the mid point of release levers 214 are axle pegs 316 and 318.

Looking at FIG. 4, release lever 214 is mounted on top of case top 222 with axle pegs 316 and 318 fitting inside indents 320 and 322, respectively. Meanwhile, arms 312 and 314 extend down through holes 324 and 326 in the case top, so that the pawl ends 330 and 332 of release lever arms 312 and 314 may abut teeth 258 and 238 of ratchet wheels 256 and 240.

Instead of the release lever depicted in this application, any other release mechanism that disengages the pawl from the ratchet wheel teeth may be used. Possible alternative embodiments include without limitation a push button, pull chord, or pull tab.

Figure 11:
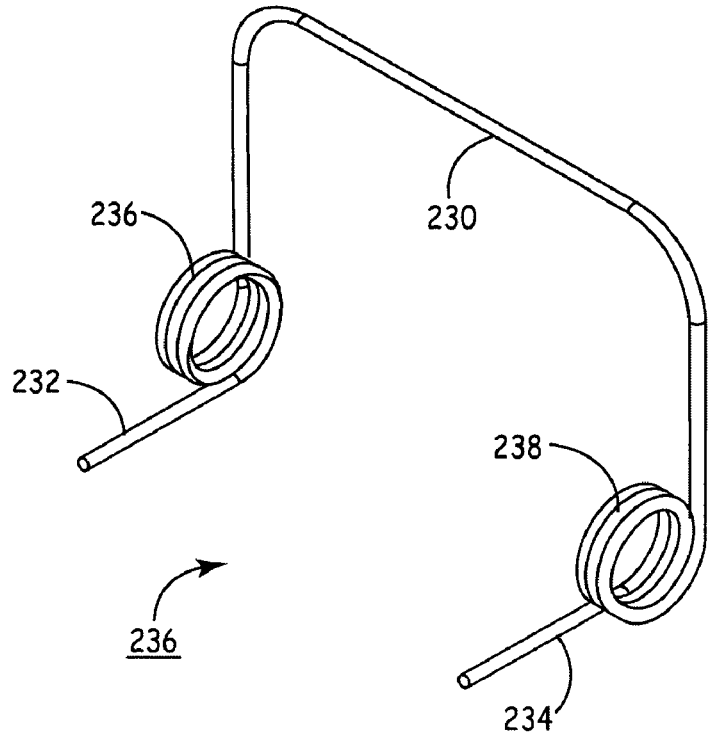
FIG. 11 illustrates a perspective view of the torsion spring of the automated tightening mechanism.

Tension spring 236 should preferably be made from 0.020 stainless steel music wire or a functionally equivalent material. As shown more fully in FIG. 11, it comprises middle bearing surface 230, bearing arms 232 and 234, and torsion rings 236 and 238. As depicted in FIG. 4, torsion spring 236 is mounted to the top of release lever 214 so that torsion rings 236 and 298 engage axle pins 316 and 315 of the release lever. Bearing arms 232 and 234 of torsion spring 214 abut shoulders 240 and 242 of release arm 214. Alternatively, a compression spring or leaf spring may be employed to bias the release lever pawls into engagement with the ratchet wheel teeth of the automated tightening mechanism.

Figure 12:
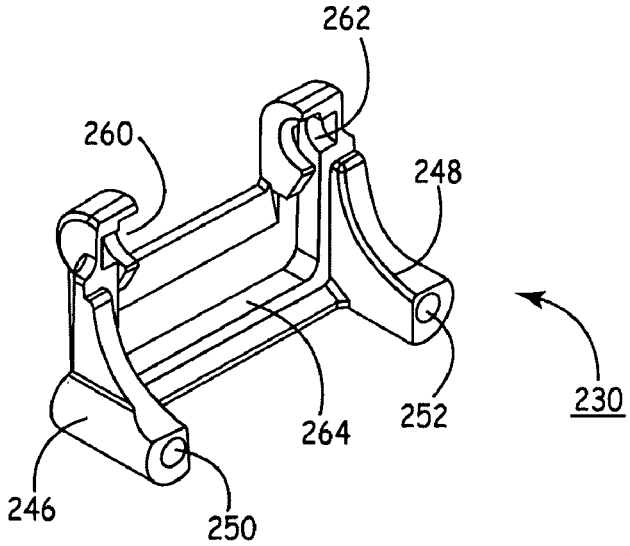
FIG. 12 illustrates an upside-down perspective view of the case cap of the automated tightening mechanism.

Case cap 230 is shown in greater detail in FIG. 12. Molded preferably from RTP 301 polycarbonate glass fiber 10% or functionally equivalent material, it features posts 246 and 248 boring through holes 250 and 252, so that screws 232 and 233 can be used to mount case cap 230 to case bottom 220 using screw holes 254 and 256 (see FIG. 7). Axle pegs 316 and 318 of release lever 214 are trapped between indents 260 and 262 of case cap 230 (FIG. 12) and indents 322 and 324 of case top 222, so that release lever 214 may pivot within the automated tightening mechanism. Shoulder 264 along the interior surface of case cap 230 provides an abutment surface for bearing portion 230 of torsion spring 236. Instead of screws, other appropriate fastening means, such as glue or sonic welding may be employed to secure the housing parts of the automated tightening mechanism together.

In operation, the wearer will position his foot so that actuator wheel 212 extending from the rear of the shoe sole 120 of the automated tightening shoe 110 abuts the floor or ground. By rolling the heel of the shoe away from his body, actuator wheel 212 will rotate in the counterclockwise direction. Shaft assembly 224 and associated axles 242 and 244 will likewise rotate in the counterclockwise direction, thereby winding laces 136 and 137 around axles 242 and 244 within the housing of the automated tightening mechanism. In doing so, laces 136 and 137 will tighten within shoe 110 around the wearer's foot. Pawl ends 330 and 332 of the release lever 214 will successively engage each tooth 238 and 258 of ratchet wheels 240 and 256 to prevent clockwise rotation of the ratchet wheels that would otherwise allow the axles 242 and 242 to rotate to loosen the shoe laces. Torsion spring 236 bears against abutment surface 264 inside case cap 230 and shoulders 240 and 244 of release lever 214 to bias the pawl ends of release lever 214 into engagement with the ratchet wheel teeth.

If the wearer wants to loosen the shoe laces 136 and 137 or closure panel 170 to take off shoe 110, he merely needs to push down release lever 214, which extends preferably from the rear sole of the shoe. This overcomes the bias of torsion spring 236 to cause pawl ends 330 and 332 to disengage from the teeth of ratchet heels 240 and 256, as described above. As axles 242 and 244 rotate in the clockwise direction, the shoes laces 136 and 137 or closure panel 170 will naturally loosen.

The automated tightening mechanism 210 of the present invention is simpler in design than other devices known within the industry. Thus, there are fewer parts to assemble during shoe manufacture and to break down during usage of the shoe. Another substantial advantage of the automated tightening mechanism embodiment 210 of the present invention is that shoe laces 136 and 137 and their associated guide tubes may be threaded down the heel portion of the shoe upper, instead of diagonally through the medial and lateral uppers. This feature greatly simplifies manufacture of shoe 110. Moreover, by locating automated tightening mechanism 210 closer to the heel within shoe sole 120, a smaller housing chamber 200 may be used, and the unit may more easily be inserted and glued into a smaller recess within the shoe sole during manufacture.

Wheel actuator 212 may be any size in diameter as long as it can extend from the shoe sole without interfering with the normal walking or running usage of the shoe. At the same time, it must fit within the housing for the automated tightening mechanism. It should be ¼-1½ inches in diameter, preferably one inch in diameter. It may be made from any resilient and durable material like urethane rubber, synthetic rubber, or a polymeric rubber-like material.

The laces 136, 137 and engagement cables 190,192, 162 of the present invention may be made from any appropriate material, including but not limited to Spectra® fiber, Kevlar®, nylon, polyester, or wire. It should preferably be made from a Spectra core with a polyester exterior weave. Ideally, the engagement cables will have a tapered profile, compared with the laces 136, 137 for ease of transport within tubes 148, 150, 162. The strength of the engagement cables and/or laces can fall within a 200-1000 pound test weight.

Tubes 148, 150, 162 may be made from any appropriate material, including but not limited to nylon or Teflon®. They should be durable to protect the engagement cables or laces, while exhibiting self-lubricating properties in order to reduce friction as the engagement cable or lace passes through the tube during operation of the automated tightening mechanism.

The above specification and drawings provide a complete description of the structure and operation of the automated tightening mechanism and shoe of the present invention. However, the invention is capable of use in various other combinations, modifications, embodiments, and environments without departing from the spirit and scope of the invention. For example, the engagement cables may be routed along the exterior of the shoe upper, instead of inside the shoe upper between the inside and outside layers of material. Moreover, the automated tightening mechanism may be located in a different position within the sole besides the rear end, such as a mid point or toe. In fact, the automated tightening mechanism may be secured to the exterior of the shoe, instead of within the sole. Multiple actuating wheels may also be used to drive a common axle of the automated tightening mechanism. While the actuator has been described as a wheel, it could adopt any of a number of other possible shapes, provided that they can be rolled along a flat surface. Therefore, the description is not intended to limit the invention to the particular form disclosed.

I claim:

1. An automated tightening shoe, comprising:

(a) a shoe having a sole and an upper connected to the sole, the upper including a toe, a heel, a medial side portion, and a lateral side portion;

(b) a closure means connected to the medial and lateral side portions of the upper for drawing them around a foot placed inside the shoe;

(c) a tightening mechanism secured to the shoe sole, the tightening mechanism including an axle with an actuator wheel rigidly connected to the axle and extending beyond the shoe at its rear heel end;

(d) at least one engagement cable connected at its one end to the closure means, and at its other end to the tightening mechanism;

(e) whereby rotation of the actuator wheel extending beyond the shoe sole causes rotation of the axle of the tightening mechanism to draw the engagement cable in a tightening direction to draw the closure means and medial and lateral side upper portions around the foot, securement means operatively connected to the tightening mechanism acting to impede counter-rotation of the axle to prevent the engagement cable from loosening; and (f) release means operatively connected to the securement means for selective disengagement of the securement means to enable counter-rotation of the axle to allow the closure means to loosen.

2. An automated tightening shoe, comprising:

(a) a shoe having a sole and an upper connected to the sole, the upper including a toe, a heel, a medial side portion, and a lateral side portion;

(b) a closure means connected to the medial and lateral side portions of the upper for drawing them around a foot placed inside the shoe;

(c) a tightening mechanism secured to the shoe, the tightening mechanism including an axle with an actuator wheel rigidly connected to the axle and extending beyond the shoe;

(d) at least one engagement cable connected at its one end to the closure means, and at its other end to the tightening mechanism;

(e) whereby rotation of the actuator wheel extending beyond the shoe against the ground or other hard surface causes rotation of the axle of the tightening mechanism to draw the engagement cable in a tightening direction to draw the closure means and medial and lateral side upper portions around the foot, securement means operatively connected to the tightening mechanism acting to impede counter-rotation of the axle to prevent the engagement cable from loosening; and (f) release means operatively connected to the securement means for selective disengagement of the securement means to enable counter-rotation of the axle to allow the closure means to loosen.

3. The automated tightening shoe of claim 2, wherein the closure means comprises:

(a) a plurality of guide means spaced along the edge of the medial and lateral side uppers; and (b) at least one shoe lace extending through alternate ones of the guide means in criss-cross or zig-zag fashion with its end connected to the engagement cable.

4. The automated tightening shoe of claim 3, wherein the guide means comprises at least one lace eyelet.

5. The automated tightening shoe of claim 3, wherein the guide means comprises at least one hook.

6. The automated tightening shoe of claim 2, further comprising a chamber in the sole for containing the tightening mechanism.

7. The automated tightening shoe of claim 6, wherein the chamber is located closely adjacent to the heel of the shoe.

8. The automated tightening shoe of claim 2, wherein the tightening mechanism is attached to the exterior of the shoe.

9. The automated tightening shoe of claim 2, wherein the securement means comprises:

(a) at least one ratchet wheel having a plurality of teeth, such ratchet wheel attached to the axle of the tightening mechanism in a fixed relationship; and (b) pawl means connected to the release means, such pawl means engaging a tooth along the ratchet wheel to prevent counter-rotation of the axle of the tightening mechanism.

10. The automated tightening shoe of claim 2 further comprising bias means for forcing the release means into engagement with the securement means.

11. The automated tightening shoe of claim 10, wherein the bias means comprises a torsion spring.

12. The automated tightening shoe of claim 2 further comprising a housing surrounding the tightening mechanism.

13. The automated tightening shoe of claim 2, wherein the release means comprises a pivotable lever.

14. The automated tightening shoe of claim 2, wherein the release means comprises a push button.

15. The automated tightening shoe of claim 2, wherein the release means comprises a pull loop.

16. The automated tightening shoe of claim 2 further comprising at least one guide tube located within the shoe upper for containing the engagement cable.

17. The automated tightening shoe of claim 2, wherein the shoe comprises an athletic shoe.

18. The automated tightening shoe of claim 2, wherein the shoe comprises a hiking shoe.

19. The automated tightening shoe of claim 2, wherein the shoe comprises a boot.

20. The automated tightening shoe of claim 2, wherein the shoe comprises a recreational shoe.

* * * * *